US009968226B1

(12) United States Patent
Anderson

(10) Patent No.: US 9,968,226 B1
(45) Date of Patent: May 15, 2018

(54) BATHROOM FIXTURE ASSEMBLY FOR FALL PROTECTION

(71) Applicant: Alvin Joseph Anderson, Bisbee, AZ (US)

(72) Inventor: Alvin Joseph Anderson, Bisbee, AZ (US)

( * ) Notice: Subject to any disclaimer, the term of this patent is extended or adjusted under 35 U.S.C. 154(b) by 0 days. days.

(21) Appl. No.: 15/400,865

(22) Filed: Jan. 6, 2017

(51) Int. Cl.
*A47K 3/08* (2006.01)
*A47K 3/12* (2006.01)
*A47K 3/00* (2006.01)
*A47K 3/38* (2006.01)

(52) U.S. Cl.
CPC ..... *A47K 3/122* (2013.01); *A47K 3/003* (2013.01); *A47K 3/38* (2013.01)

(58) Field of Classification Search
CPC ..... A47K 3/38
USPC ..... 4/557–558
See application file for complete search history.

(56) References Cited

U.S. PATENT DOCUMENTS 2,242,461 A 5/1941 Fisher
2,319,017 A 5/1943 Tillman
2,549,506 A 4/1951 Moore
2,644,964 A 7/1953 Jumper
2,815,513 A 12/1957 Tilson
2,817,095 A 12/1957 Jeffries
2,885,690 A 5/1959 Scott
3,114,154 A * 12/1963 Laughlin ..... A47K 3/003 4/576.1
3,228,038 A 1/1966 Augustine
3,448,468 A * 6/1969 Murcott ..... A47K 3/003 4/577.1
3,568,220 A 3/1971 Dees
3,604,019 A * 9/1971 Garner ..... A47K 3/003 4/576.1
3,996,631 A * 12/1976 Fields ..... A47K 3/001 4/254
3,996,634 A 12/1976 Grind
4,162,544 A 7/1979 Freeman
4,228,552 A 10/1980 Weaver
4,498,204 A * 2/1985 Warner ..... A47K 3/003 4/254
4,908,906 A 3/1990 Hanna
5,050,252 A 9/1991 Cuttriss
D371,829 S * 7/1996 Greger ..... A47K 3/003 D23/304
5,577,275 A 11/1996 Guenther
5,586,352 A * 12/1996 O'Brien ..... A61G 7/053 248/200.1

(Continued)

*Primary Examiner* — Lori Baker
(74) *Attorney, Agent, or Firm* — Michelle L. Gross, P.C.

(57) ABSTRACT

A bathroom fixture assembly comprising a plurality of rigid vertical members each comprising a first end configured to couple to a ceiling and a second end configured to extend downward beyond an upper edge of an outer wall of a basin of a bathtub or shower. The assembly may comprise a shower curtain channel configured to house a fully-functioning shower curtain. The assembly may further comprise one or more gates that may be used as grab bars and that may lock into position about a 180 degree range of motion around any of the rigid vertical members. The assembly may further comprise a seat, which may pivot from an upward position to a horizontal position when use is desired. The assembly may optionally comprise an exterior seat, cabinet, light, multi-use davit/hook, and/or physical therapy sky hook.

20 Claims, 13 Drawing Sheets

(56) References Cited

U.S. PATENT DOCUMENTS

| | | | | |
|---|---|---|---|---|
| 5,659,904 | A | 8/1997 | Doczy | |
| 5,970,535 | A | 10/1999 | Wayne | |
| 6,049,920 | A * | 4/2000 | Mochizuki | A47K 3/38 160/368.1 |
| 6,381,772 | B1 | 5/2002 | Dawson | |
| 6,507,960 | B1 | 1/2003 | Kelly | |
| 7,124,451 | B2 | 10/2006 | Moore | |
| 7,171,705 | B1 | 2/2007 | Hicks | |
| 7,203,978 | B1 * | 4/2007 | Chang | A47K 3/003 4/577.1 |
| 7,213,276 | B2 * | 5/2007 | Palma | A47K 3/12 4/573.1 |
| D584,129 | S * | 1/2009 | Miller | A47K 3/12 D8/315 |
| 7,823,229 | B2 | 11/2010 | O'Brien et al. | |
| 7,823,230 | B2 * | 11/2010 | Meyers | A47K 3/003 4/577.1 |
| 7,877,824 | B2 | 2/2011 | Grant | |
| 8,393,020 | B2 * | 3/2013 | Grant | A47K 3/003 16/436 |
| 8,533,912 | B2 | 9/2013 | Tran | |
| 9,339,901 | B2 * | 5/2016 | Miller | B23P 19/04 |
| 2011/0232665 | A1 * | 9/2011 | Barnett, Jr. | A45B 7/00 132/200 |

* cited by examiner

BATHROOM FIXTURE ASSEMBLY FOR FALL PROTECTION

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

1. Field of the Invention

Example embodiments in general relate to a bathroom fixture assembly intended to improve user safety by reducing incidence of falls, and to otherwise improve the shower experience by facilitating options within a heretofore vacant and useless shower plane.

2. Related Art

According to a Centers for Disease Control and Prevention (CDC) report entitled "Nonfatal Bathroom Injuries Among Persons Aged ≥15 Years," a bathroom's bath or shower is the most dangerous area of the home. Each year, approximately 235,000 people over the age of 15 years visit emergency rooms due to bathroom injuries, and more than a third of these injuries happen while bathing, showering or getting into or out of a bathtub or shower.

Though shower tub-related injuries increase with age, they are proportionately most common among people who are 15-24 years old (84.5%), and least common among those over 85 (38.9%). Studies suggest that women are most at risk. Their injury rate is 72% higher than the rate attributed to men. Speculation as to why abounds, but may include differences in physical activity such as for example, the prevalence of women, as opposed to men, who multi-task in the bathroom by performing tasks such as tending to children, shaving in the shower, or wiping-down shower or tub walls while or just after bathing. Additionally, women may tend to use skin and hair care products that contain oils and or other ingredients which may contribute to more slippery shower or shower tub area surfaces when wet.

Conventional grab bars for use in a shower or bathtub are commonly only accessible once the user is inside of the shower or bathtub, leaving the user unprotected and prone to slipping and/or falling while entering or existing the bathtub or shower. An additional safety hazard may be caused by the common occurrence of "shower cling," i.e. the shower curtain blowing into the tub or shower and clinging to the user during the bathing process.

SUMMARY

An example embodiment of the present invention is directed to a bathroom fixture assembly which serves as a fall prevention system. The assembly includes various features that individually or in combination prevent users from slipping and/or falling in a slippery location such as a bathtub or shower.

There has thus been outlined, rather broadly, some of the features of the grab bar assembly in order that the detailed description thereof may be better understood, and in order that the present contribution to the art may be better appreciated. There are additional features of the grab bar assembly that will be described hereinafter and that will form the subject matter of the claims appended hereto. In this respect, before explaining at least one embodiment of the grab bar assembly in detail, it is to be understood that the grab bar assembly is not limited in its application to the details of construction or to the arrangements of the components set forth in the following description or illustrated in the drawings. The grab bar assembly is capable of other embodiments and of being practiced and carried out in various ways. Also, it is to be understood that the phraseology and terminology employed herein are for the purpose of the description and should not be regarded as limiting.

Implementations of a bathroom fixture assembly may comprise a plurality of rigid vertical members each comprising a first end configured to couple to a ceiling and a second end configured to extend downward beyond an upper edge of an outer wall of a basin of a bathtub or shower, a first horizontal member coupled to the second end of a first rigid vertical member from among the plurality of rigid vertical members and configured to extend outwardly toward the outer wall of the basin of the bathtub or shower, and a first vertical curtain channel member coupled to the first horizontal member and configured to extend upward proximal an interior surface of the outer wall of the basin of the bathtub or shower such that a channel configured to house a shower curtain exists between the first rigid vertical member and the first vertical curtain channel member. The bathroom fixture assembly may further comprise a first horizontal extension member coupled to the vertical curtain channel member and configured to extend horizontally over the upper edge of the outer wall of the basin of the bathtub or shower and a first lower rigid vertical member from among a plurality of lower rigid vertical members, the first lower rigid vertical member coupled to the first horizontal extension member and configured to extend downward proximal an exterior surface of the outer wall of the basin of the bathtub or shower and couple to a floor surface.

Particular aspects may comprise one or more of the following features. The bathroom fixture assembly may further comprise a seat pivotally coupled between the first rigid vertical member and a second rigid vertical member, the seat configured to pivot from a closed, vertical position to an open position that is substantially perpendicular to the first and second rigid vertical members. The bathroom fixture assembly may further comprise at least one leg pivotally coupled to a bottom surface of the seat and configured to retain the seat in the open position when a user is seated on the seat. The bathroom fixture assembly may further comprise a first gate coupled to the first rigid vertical member and configured to pivot up to about 180 degrees about the first rigid vertical member. The bathroom fixture assembly may further comprise a second gate coupled to a second rigid vertical member from among the plurality of rigid vertical members, the second gate configured to pivot up to about 180 degrees about the second rigid vertical member. The first gate may comprise a substantially c-shaped member, each end of which is pivotally coupled to the first rigid vertical member and at least one horizontal gate member comprising a first end coupled to the substantially c-shaped member and a second end pivotally coupled to the first rigid vertical member. The bathroom fixture assembly may further comprise a grab ring coupled to the first rigid vertical member. At least one of the first rigid vertical member and the first lower rigid vertical member may comprise at least one of a telescoping section and a threaded adjustable section.

Implementations of a bathroom fixture assembly may comprise a plurality of rigid vertical members each comprising a first end configured to couple to a ceiling and a second end configured to extend downward beyond an upper edge of an outer wall of a basin of a bathtub or shower, a first horizontal member coupled to the second end of a first rigid vertical member from among the plurality of rigid vertical members and configured to extend outwardly toward the outer wall of the basin of the bathtub or shower, and a first vertical curtain channel member coupled to the first horizontal member and configured to extend upward proximal an interior surface of the outer wall of the basin of the bathtub or shower such that a channel configured to house a shower curtain exists between the first rigid vertical member and the first vertical curtain channel member. The bathroom fixture assembly may further comprise a first horizontal extension member coupled to the vertical curtain channel member and configured to extend horizontally over the upper edge of the outer wall of the basin of the bathtub or shower, a first lower rigid vertical member from among a plurality of lower rigid vertical members, the first lower rigid vertical member coupled to the first horizontal extension member and configured to extend downward proximal an exterior surface of the outer wall of the basin of the bathtub or shower, and at least one set screw configured to extend from at least one of the first vertical curtain channel member and the first lower rigid vertical member toward the outer wall of the basin of the bathtub or shower.

Particular aspects may comprise one or more of the following features. The bathroom fixture assembly may further comprise at least one bumper extending from the first vertical curtain channel member on a surface proximal the interior surface of the outer wall of the basin of the bathtub or shower and at least one bumper extending from the first lower rigid vertical member on a surface proximal the exterior surface of the outer wall of the basin of the bathtub or shower. The bathroom fixture assembly may further comprise a second horizontal member coupled to the second end of a second rigid vertical member from among the plurality of rigid vertical members and configured to extend outwardly toward the outer wall of the basin of the bathtub or shower, a second vertical curtain channel member coupled to the second horizontal member and configured to extend upward proximal an interior surface of the outer wall of the basin of the bathtub or shower such that a channel configured to house a shower curtain exists between the second rigid vertical member and the second vertical curtain channel member, a second horizontal extension member coupled to the second vertical curtain channel member and configured to extend horizontally over the upper edge of the outer wall of the basin of the bathtub or shower, a second lower rigid vertical member from among the plurality of lower rigid vertical members, the second lower rigid vertical member coupled to the second horizontal extension member and configured to extend downward proximal an exterior surface of the outer wall of the basin of the bathtub or shower, and at least one set screw configured to extend from at least one of the second vertical curtain channel member and the second lower rigid vertical member toward the outer wall of the basin of the bathtub or shower. The bathroom fixture assembly may further comprise an exterior support member comprising a first end coupled to the first lower rigid vertical member and a second end coupled to the second lower rigid vertical member. The exterior support member may further comprise one or more tension screws. The first horizontal extension member and the second horizontal extension member may be integral to one another. The first vertical curtain channel member and the second vertical curtain channel member may be integral to one another. The bathroom fixture assembly may further comprise a cushion located on an underside of the integral horizontal extension member. The bathroom fixture assembly may further comprise a seat pivotally coupled between the first rigid vertical member and a second rigid vertical member, the seat configured to pivot from a closed, vertical position to an open position that is substantially perpendicular to the first and second rigid vertical members and at least one gate coupled to the at least one of the first and second rigid vertical members and configured to pivot up to about 180 degrees about the rigid vertical member to which the gate is pivotally coupled.

Implementations of a bathroom fixture assembly may comprise a plurality of rigid vertical members each comprising a first end configured to couple to a ceiling and a second end configured to extend downward to a shower floor, a first horizontal member coupled to the second end of a first rigid vertical member from among the plurality of rigid vertical members and configured to extend outwardly toward the outside of the shower, and a first vertical curtain channel member coupled to the first horizontal member and configured to extend upward proximal the first rigid vertical member such that a channel configured to house a shower curtain exists between the first rigid vertical member and the first vertical curtain channel member. The bathroom fixture assembly may further comprise a first horizontal extension member coupled to the vertical curtain channel member and configured to extend horizontally outward from the shower and a first lower rigid vertical member from among a plurality of lower rigid vertical members, the first lower rigid vertical member coupled to the first horizontal extension member and configured to extend downward proximal an exterior surface of the outer wall of the basin of the bathtub or shower and couple to a floor surface.

Particular aspects may comprise one or more of the following features. The bathroom fixture assembly may further comprise a second rigid vertical member comprising a first end configured to couple to the ceiling and a second end configured to extend downward to the shower floor and at least one gate coupled to the at least one of the first and second rigid vertical members and configured to pivot up to about 180 degrees about the rigid vertical member to which the gate is pivotally coupled. The first rigid vertical member may further comprise an upper horizontal member configured to extend outward from the shower such that the first end of the first rigid vertical member is configured to couple to the ceiling outside of the shower.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explain how it differs from the plain and ordinary meaning. Absent such clear statements of intent to apply a "special" definition, it is the inventor's intent and desire that the simple, plain and ordinary meaning of the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Brief Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for," and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

Example embodiments will become more fully understood from the detailed description given herein below and the accompanying drawings, wherein like elements are represented by like reference characters, which are given by way of illustration only and thus do not limit the example embodiments herein. Elements and acts in the figures are illustrated for simplicity and have not necessarily been rendered according to any particular sequence or embodiment.

DETAILED DESCRIPTION

Figure 1:
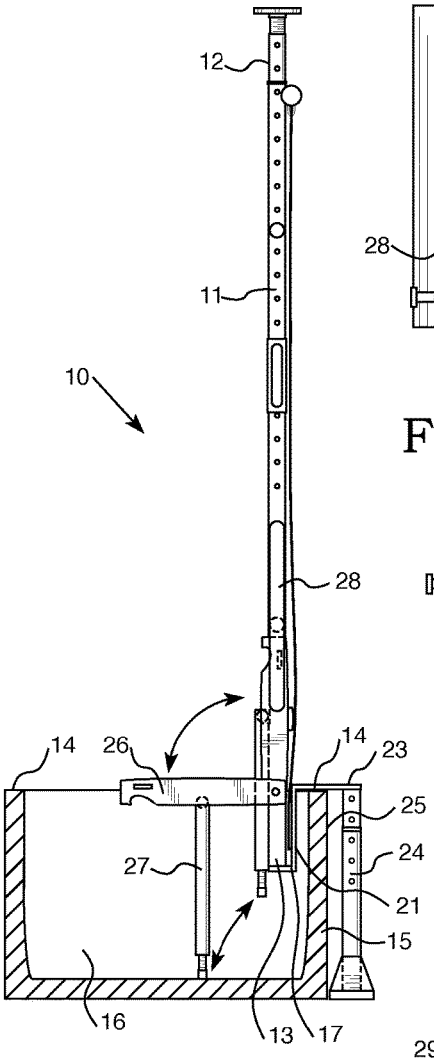
FIG. 1 is a side view of a bathroom fixture assembly in accordance with an exemplary embodiment.

Unless otherwise defined, all technical and scientific terms used herein have the same meaning as commonly understood by one of ordinary skill in the art to which this invention belongs. Although methods and materials similar to or equivalent to those described herein can be used in the practice or testing of a bathroom fixture assembly such as a grab bar assembly, suitable methods and materials are described above. All publications, patent applications, patents, and other references mentioned herein are incorporated by reference in their entirety to the extent allowed by applicable law and regulations. The bathroom fixture assembly may be embodied in other specific forms without departing from the spirit or essential attributes thereof, and it is therefore desired that the present embodiments be considered in all respects as illustrative and not restrictive. Any headings utilized within the description are for convenience only and have no legal or limiting effect.

Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact. As used herein, phrases such as "make contact with," "coupled to," "touch," "interface with" and "engage" may be used interchangeably.

The features, structures, or characteristics of the invention described throughout this specification may be combined in any suitable manner in one or more embodiments. For example, the usage of the phrases "exemplary embodiments," "some embodiments" or other similar language refers to the fact that a particular feature, structure, or characteristic described in connection with the embodiment may be included in at least one embodiment of the present invention. Thus, appearances of the phrases "exemplary embodiments," "in some embodiments," "in other embodiments" or other similar language, throughout this specification do not necessarily all refer to the same group of embodiments, and the described features, structures, or characteristics may be combined in any suitable manner in one or more embodiments.

Implementations of the disclosed bathroom fixture assembly provides a user fall protection both outside, inside, and while entering and exiting the bathing enclosure. More importantly, these same fall protection elements of the fixture assembly are always, unless a user prefer they not be in view, directly accessible and not obscured or hidden by a shower curtain. Additionally, shower curtain cling is also avoided so as not to allow a user to become entangled in the shower curtain as with conventional showers or tubs, including those with conventional grab bars.

Implementations of the disclosed bathroom fixture assembly addresses another surmountable issue in a typical small home: replacing wasted space with multi-use functionality so that users may live large in small spaces. Small homes, apartments and condominiums, for example, often do not conveniently support their inhabitants' physical therapy interventions. That is, they often lack sufficient, clutter-free, mirrored and/or fall-proof space within which to safely, conveniently and regularly follow physical therapy and/or other indoor exercise programs. Relatedly, in what limited clutter-free space does exist, those same homes may lack strong and space-efficient housewares with, upon, or against which to safely perform such exercise programs.

Daily physical activity for anyone can improve balance, keep muscles strong and flexible, help manage or prevent chronic diseases like diabetes, and at the same time can prevent falls and injuries anywhere, including in the bathroom where most falls occur. Although falls are the leading cause of injury and of death from injury in older Americans, and 75% of Americans over 70 are diagnosed with "abnormal" balance, there are proven ways to improve balance and avoid falls through exercise, according to the CDC, National Council on Aging (NCOA), National Institute of Health (NIH) and American Physical Therapy Association (APTA). (See, e.g., www.ncbi.nlm.hih.gov/pubmed/7715058).

With the aid of some embodiments of the disclosed bathroom fixture assembly, those who may simply be aging or have a sedentary lifestyle but who also wish to improve their strength, stability and mobility so as to live independently as long as possible, and/or those recovering from an injury, particularly those who cannot or do not drive to a gym regularly, can have a place within the home to safely, regularly and comfortably engage in physical therapy. Implementations of the bathroom fixture assembly disclosed herein may include a strong sky hook option, multiple strong lower exercise band attachment points, and critical fall protection purchases in those same lower locations outside of the shower. These implementations thereby safely "spot" users who are following home exercise programs that incorporate such a band or bands.

Meanwhile, some implementations may offer additional ways to eliminate space waste and address a typical home occupant's multi-functionality needs. For example, small homes, condos and apartments may also lack sufficient shower lighting or there may be no strong hook and davit available in the home that swings over a drained area so as to allow the user to easily deep-water heavy hanging house plants, drip-dry wet umbrellas, and/or spot-rinse or clean bulky soiled items such as comforters, furniture covers, throw-rugs, scuba gear, etc. In some circumstances, there may be no warm, private or convenient place to securely attach and control a dirty dog or other pet to efficiently wash him or her.

Implementations of the disclosed bathroom fixture assembly therefore bring safe and multi-faceted value and convenience for all of these activities by allowing a user to utilize the often over-looked and under-utilized shower-curtained space. This not only affords greater safety to the typical shower user, but enhances the home's and bathroom's functionality for those who are not necessarily bathing or taking a shower, as well.

Figure 2:
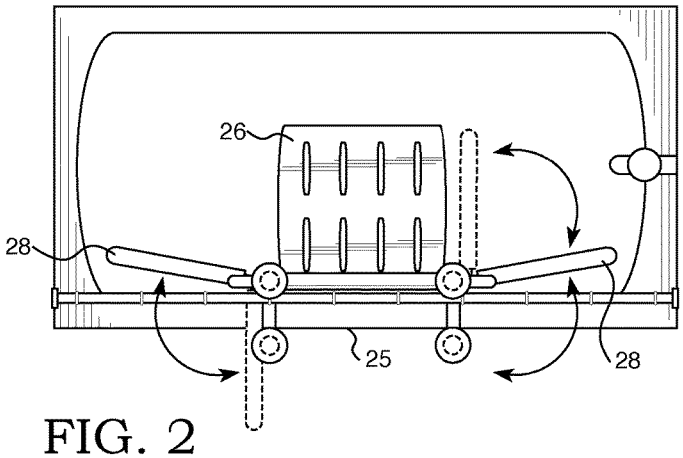
FIG. 2 is a top view of a bathroom fixture assembly in accordance with the exemplary embodiment of FIG. 1.
Figure 3:
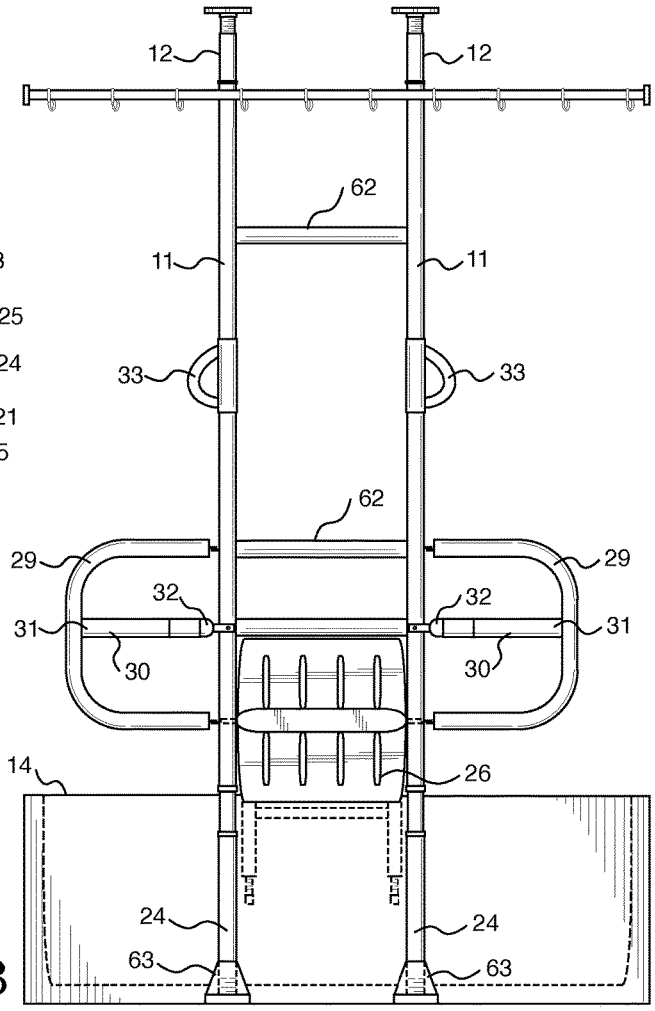
FIG. 3 is a front view of a bathroom fixture assembly in accordance with the exemplary embodiment of FIGS. 1-2.

FIGS. 1-3 depict an exemplary implementation of a bathroom fixture assembly 10 used to reduce the incidence of slip and fall injuries. As shown, some embodiments comprise a plurality of rigid vertical members 11 having a first end 12 that is configured to couple to a ceiling. One or more of the rigid vertical members 11 may be coupled to the ceiling using tension, one or more fasteners such as, by non-limiting example, screws or bolts, and/or by using any other appropriate fastener. A second end 13 of at least one of the rigid vertical members 11 extends downward past the upper edge 14 of an outer wall 15 of the basin 16 of a bathtub or shower. The second end 13 of at least one rigid vertical member 11 may be coupled to a rigid horizontal member 17 that extends toward an interior surface 22 of the outer wall 15 of the basin 16. The rigid horizontal member 17 may be coupled to a vertical curtain channel member 21 that extends upward and is substantially parallel to the rigid vertical members 11 such that a curtain channel 20 is formed that allows a shower curtain to hang therein, thereby a) maintaining a user's privacy while bathing and keeping water from escaping the shower or bathtub enclosure, while at the same time maintaining a user's immediate and direct access to the bathroom fixture assembly 10 at all times, including when a shower is in progress; and b) maintaining a user's ability to largely hide the bathroom fixture assembly 10 from view by others, simply by use of a normal shower curtain 19, which—whether the shower is in use or not—generally maintains a clean and tidy bathroom appearance and avoids any real or perceived stigma that may be associated with installing a wall-mounted or an otherwise more visible bathroom fall protection assembly.

As shown, a horizontal extension member 23 may be coupled to the vertical curtain channel member 21 such that the horizontal extension member 23 extends outward from the vertical curtain channel member 21 and passes over the outer wall 15 of the bathtub or shower basin 16. In some embodiments, the horizontal extension member 23 may rest on the upper edge 14 of the outer wall 15 of the basin for additional support and stability. The horizontal extension member 23 may be coupled to one or more lower rigid vertical members 24, which in some embodiments, may be configured to affix to a flooring surface outside of the shower or bathtub basin 16, which in some embodiments, may be accomplished using one or more of a telescoping section 34, a threaded adjustable section 35, a threaded adjustor 47, a corresponding threaded receiver 54, and/or a toe guard 63.

Some embodiments of the bathroom fixture assembly 10 may further comprise a seat 26 that is pivotally coupled between two of the rigid vertical support members 11. As shown in FIG. 1, the seat 26 may be located in an upright position when the seat 26 is not in use and then may be lowered to a position that is substantially perpendicular to the rigid vertical support members 11 when a user desires to sit on the seat 26. The seat 26 may further comprise one or more legs 27 or may be strengthened where it attaches to the upper rigid vertical support members 11 so as not to require legs 27 to provide support and stability when the seat 26 is folded open and in use. The one or more legs 27 may also pivotally couple to the seat 26 so that they remain out of a user's way when the seat 26 is not in use. In some embodiments, the seat 26 may be removably coupled to the rigid vertical members 11 so that the seat 26 may be easily detached if this component is not desired. As shown, some embodiments may comprise one or more additional horizontal members located between adjacent rigid vertical members which may be used for additional support or as additional grips or grab bars.

Additionally, as shown in FIGS. 1-3, some embodiments of the bathroom fixture assembly 10 may comprise one or more gates 28. The one or more gates 28 may be secured in various positions as needed to assist a user by providing a grab bar to use while getting into or out of a shower or bathtub, or while bathing, or while performing other bathroom activities within the shower or tub's vicinity, such as getting onto or off of a toilet that is located near the shower or tub. In some implementations, the one or more gates 28 may be configured to rotate through a range of about 180 degrees about the rigid vertical member 11 to which the gate 28 is pivotally coupled. While it is contemplated by this disclosure that a gate 28 may comprise any appropriate shape, in some embodiments, it may be preferable that the gate 28 comprises a c-shaped member 29, the ends of which are pivotally coupled to a rigid vertical member 11 and a horizontal gate member 30 comprising a first end 31 coupled to the c-shaped member 29 and a second end 32 pivotally coupled to the rigid vertical member 11.

Figure 4A:
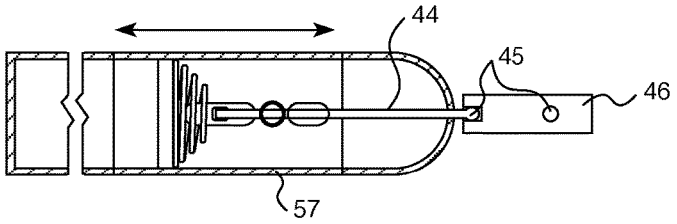
FIG. 4A depicts an implementation of a spring-loaded gate locking device.
Figure 4B:
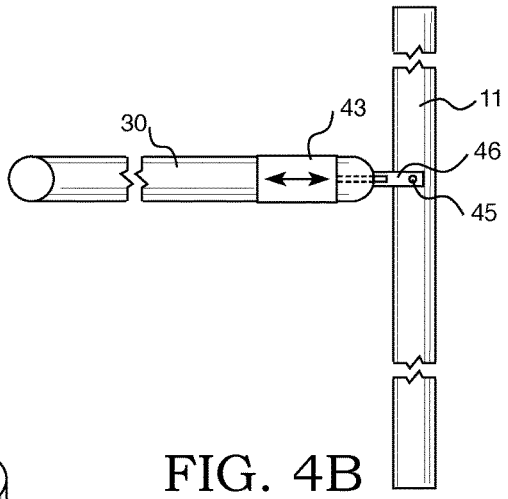
FIGS. 4B-C depict an implementation of a bathroom fixture assembly gate in various positions.
Figure 4C:
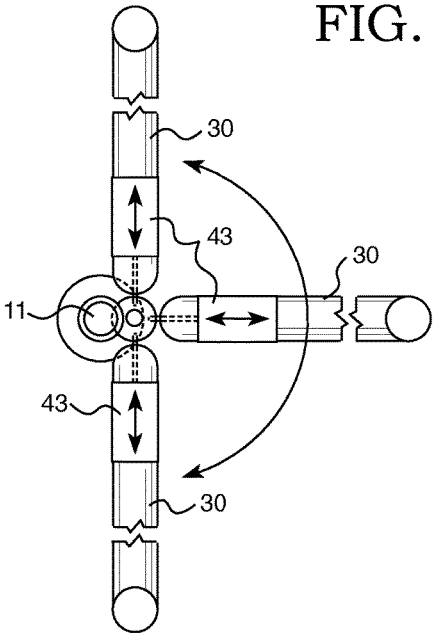

To allow the one or more gates 28 to be locked into a position such that the gate 28 becomes a stable element suitable for use as a grab bar, the gate 28 may comprise a locking mechanism such as, by non-limiting example, a spring-loaded lock 43 as shown in FIGS. 4A-C. The spring-loaded lock 43 may comprise a housing 57 such as a tube or other structure that is of sufficient diameter to allow the gate member 29, 30 to pass therethrough. The spring-loaded lock 43 is depicted here as being located on the horizontal gate member 30, however, the spring-loaded lock 43 may be located on any of gate members 29, 30 such as, for example, the c-shaped gate member 29. As shown in FIG. 4A, the spring-loaded mechanism is located with the horizontal gate member 30 such that a spring-loaded lock bolt 44 protrudes through the second end 32 of the horizontal gate member 30 and into a lock mortise 45 housed within a lock mortise collar 46. While any number of lock mortises 45 may be used depending upon how many locking positions one desires the gate 28 to have, in some embodiments, it may be preferable that the spring-loaded lock 43 comprises three lock mortises 45 located at zero, 90, and 180 degrees around a substantially round mortise collar 46, such that the gate may be locked into position when extending out of the shower or bathtub as well as into the shower or bathtub as shown in FIG. 4C. By sliding the housing 57 of the spring-loaded lock 43 outward from the rigid vertical member 11, the lock bolt 44 is retracted from the lock mortise 45 thereby allowing the gate 28 to rotate about the rigid vertical member 11 along the mortice collar 46. Because the lock is spring-loaded, as the gate 28 rotates to the point at which the next lock mortice 45 is located along the mortice collar 46, the lock bolt 44 will automatically reengage when aligned with the next mortice 45. In implementations comprising two gates 28 as shown, the gates 28 may be swung into the shower or bathtub and locked on either side of the seat to create "arms" similar to those of an armchair to assist in propping a user up and/or to prevent a user from falling when seated due to slipping or loss of balance.

Figure 5:
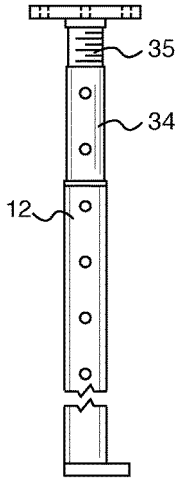
FIG. 5 is an exemplary implementation of a rigid vertical member comprising an adjustable portion in accordance with an embodiment of a bathroom fixture assembly.
Figure 6:
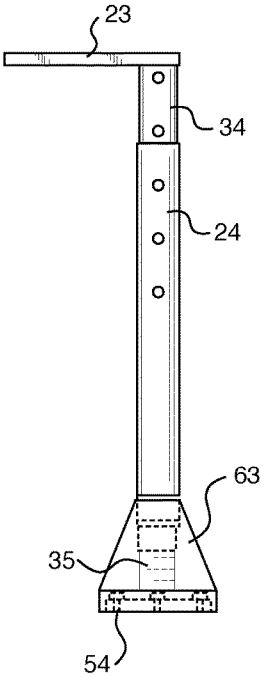
FIG. 6 is an exemplary implementation of a lower rigid vertical member comprising an adjustable portion in accordance with an embodiment of a bathroom fixture assembly.
Figure 7:
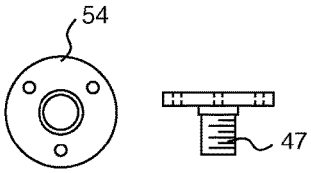
FIG. 7 provides an example of a threaded adjustor of FIG. 6.

FIGS. 5-6 illustrate examples of telescoping sections 34 and threaded adjustable sections 35 of a first end of a rigid vertical member 11 and a lower rigid vertical member 24, respectively. The telescoping sections 34 may be adjusted when a larger length variation is needed to properly affix the bathroom fixture assembly 10 to the ceiling or floor. The threaded adjustable section 35 provides finer adjustment to ensure a snug fit and proper tensional coupling without damaging the ceiling or floor by applying excessive force and may comprise a floor or ceiling flange. As shown in FIGS. 6-7, one or more threaded adjustors 47 may be used for further fine adjustment and/or leveling of the lower rigid vertical member 24 by tightening or loosening the threaded adjustor 47 within a corresponding threaded receiver 54. FIG. 6 illustrates that one type of toe guard 63 protective cover can be made of soft molded PVC, or the like, which covers the flange and associated hardware from view, keeps them clean, and protects toes and other body parts from direct contact with any hard or sharp material. For these same reasons, this type of toe guard 63 could cover assembly 10 and basin floor 16 contact point(s), such as any seat 26 leg 27 shown in FIG. 1.

Figure 8:
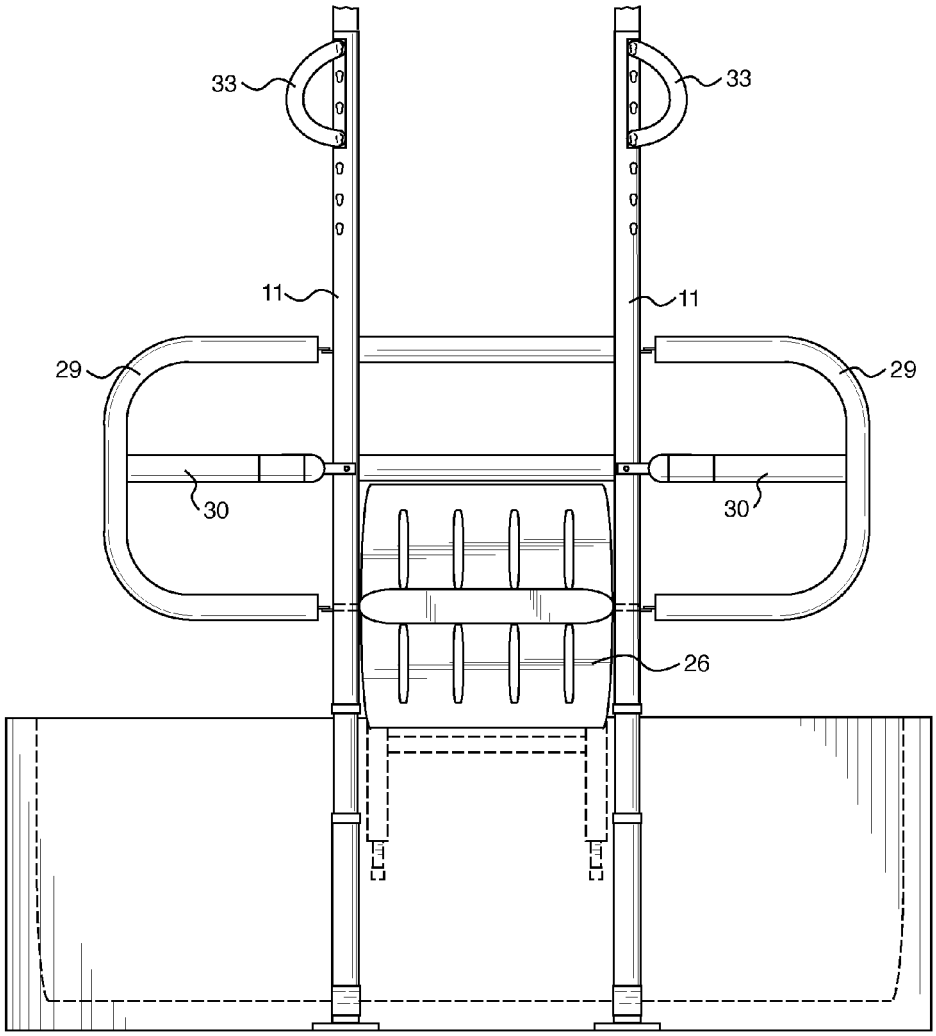
FIG. 8 depicts an exemplary embodiment of a bathroom fixture assembly comprising a plurality of handles located within a basin of a bathtub or shower.
Figure 9A:
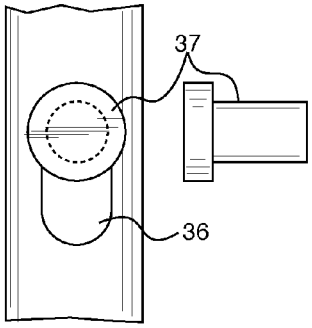
FIGS. 9A-9B depict a skeleton key slot and pin as used to hold the plurality of handles in place.
Figure 9B:
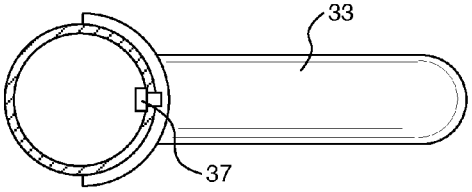

As shown in FIGS. 8-9B, some embodiments of a bathroom fixture assembly 10 may optionally comprise one or more grab rings 33 which may fixedly or detachably couple to the rigid vertical members 11. While any fastening or attachment mechanism may be used to couple the grab rings 33 to the rigid vertical members 11, in some embodiments, it may be desirable that the rigid vertical members 11 comprise one or more skeleton key slots 36 into which a skeleton key pin 37 may be secured to hold the grab ring 33 in a desired location along the rigid vertical member 11. This allows for ease in moving the grab rings 33 to a convenient position to act as an additional grippable support for the user to grasp.

Figure 10A:
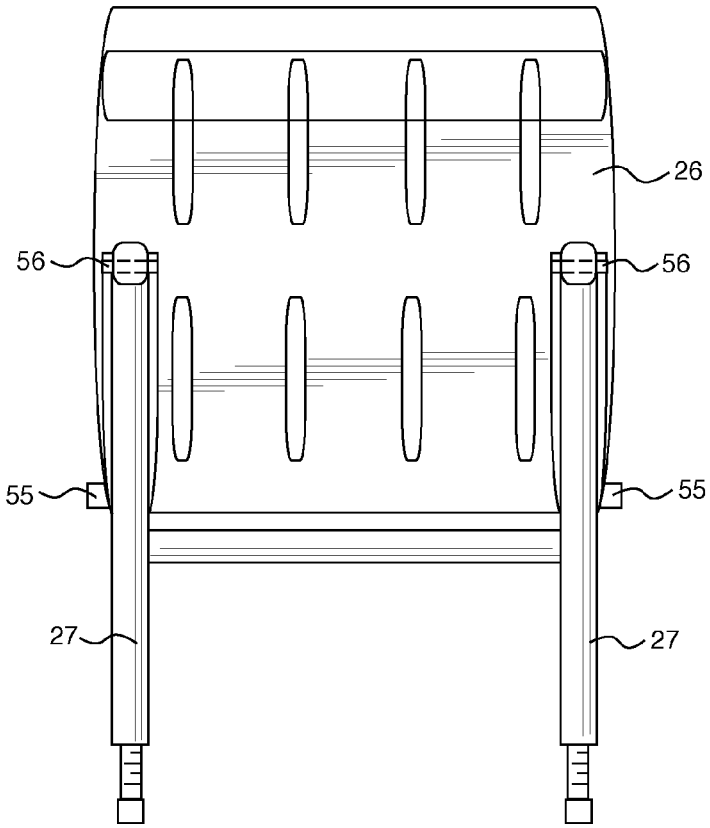
FIGS. 10A-B depict an exemplary embodiment of a seat in accordance with an implementation of a bathroom fixture assembly.
Figure 10B:
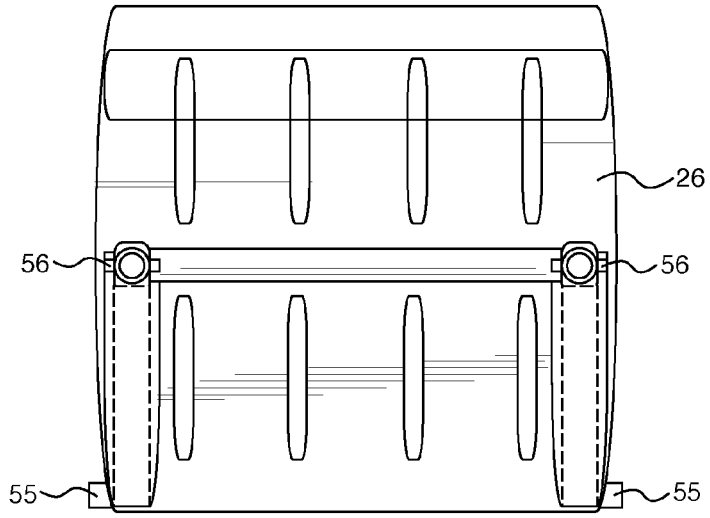

FIGS. 10A-B provide an example of an embodiment of an optional seat 26 for use with some implementations of a bathroom fixture assembly 10. As shown, the seating surface 26 may be located in a position that is substantially parallel to the rigid vertical members 11 and/or the outer wall 15 of a bathtub or shower basin 16 when not in use. This allows the seat 26 to have a slimmer profile and occupy less space when the seat 26 is not in use. Seat hinges 55 may be located on either side of the seat 26 to allow the seat 26 to pivot to a downward position that is substantially perpendicular to the rigid vertical members 11. Additionally, if there are seat 26 legs 27 used, one or more legs 27 may be hingedly coupled to the underside of the seat 26 using one or more leg hinges 56 such that the one or more legs also remain in a vertical position when the seat 26 is in an upright position. The one or more legs 27 may be used to better support that weight of user seated on the seat 26 and may comprise a threaded or otherwise adjustable section to allow for adjustment in the length of the legs 27 and thus, in the corresponding position of the seat 26 when the legs 27 are in use. While the seat 26 may be comprised of any suitable material, in some embodiments, the seat may be comprised of a plastic or other synthetic material that may be textured or coated with a non-slip finish and may optionally comprise one or more drainage slots.

Figure 11:
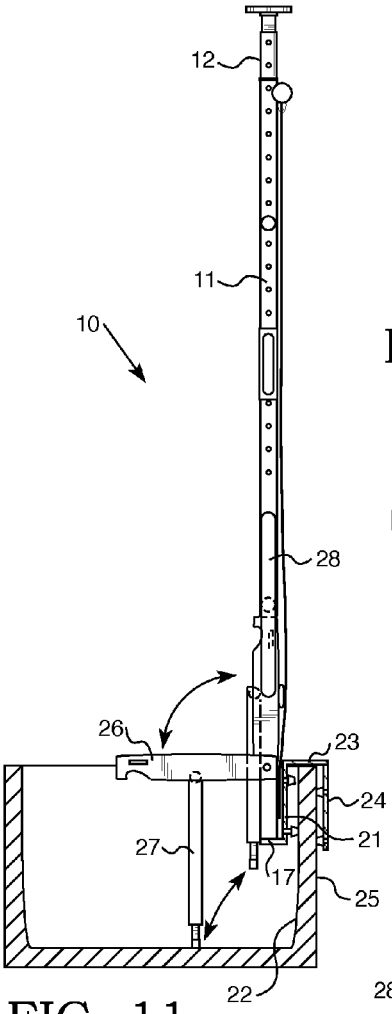
FIGS. 11-13 depict side, top and front views, respectively, of a first alternative embodiment of a bathroom fixture assembly.
Figure 12:
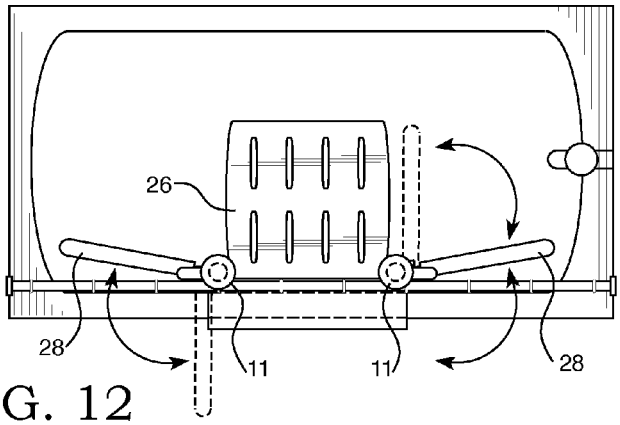
Figure 13:
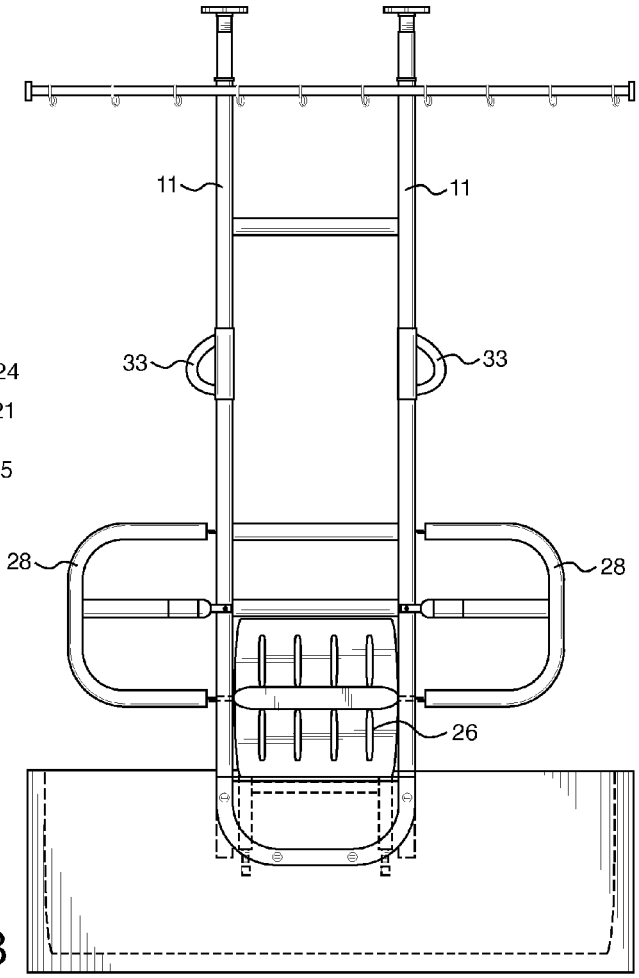
Figure 14:
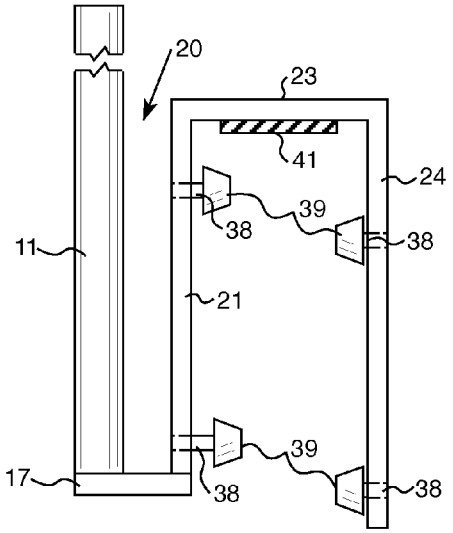
FIG. 14 depicts a shower curtain channel in accordance with the embodiment of FIGS. 11-13.
Figure 15:
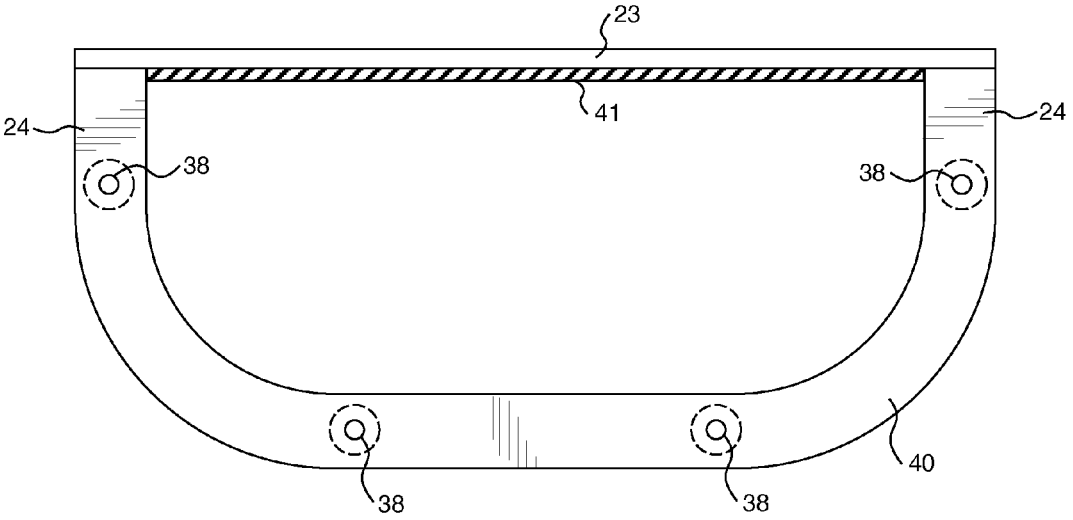
FIG. 15 depicts a front view of an exterior support member in accordance with the embodiment of FIGS. 11-14.

FIGS. 11-13 provide an alternative embodiment of a bath fixture assembly 10. Here, the lower rigid vertical member 24 extends only partially along the exterior surface 25 of the outer wall 15 of the basin 16 of a shower or bathtub, thereby yoking the shower or tub wall surface for support. As shown in FIG. 14, one or more tension screws 38 may be located on the vertical curtain channel member 21 and/or the lower rigid vertical member 24 to allow for adjustment of the force applied against the outer wall 15 of the shower or bathtub basin 16 in order to secure the bath fixture assembly 10 in place regardless of the wall 15 contour. The tension screws 38 may be accompanied by one or more bumpers 39 which are preferably comprised of a relatively soft, non-marking material, such as by non-limiting example, rubber or plastic, so as not to damage the surface of the outer wall 15 of the bathtub or shower. A cushion 41 comprised of a soft, padded material may be located on the underside of the horizontal extension member 23 to provide further protection against damage to the upper edge 14 of the outer wall 15 of the basin 16. As shown in FIG. 15, some embodiments may further comprise an exterior support member 40 that couples two or more lower rigid vertical members 24 together to increase stability of the bathroom fixture assembly as mounted. This exterior support member 40 may further comprise one or more tension screws 38 and/or bumpers 39 to allow for additional adjustment when mounting the bathroom fixture assembly 10 to ensure proper fit relative to the outer wall 15 of the bathtub or shower basin 16. While the exterior support member 40 may be coupled to any number of lower rigid vertical members 24, it is also contemplated by this disclosure that a plurality of horizontal extension members 23, and/or vertical curtain channel members 21 may also be integral to one another.

Figure 16:
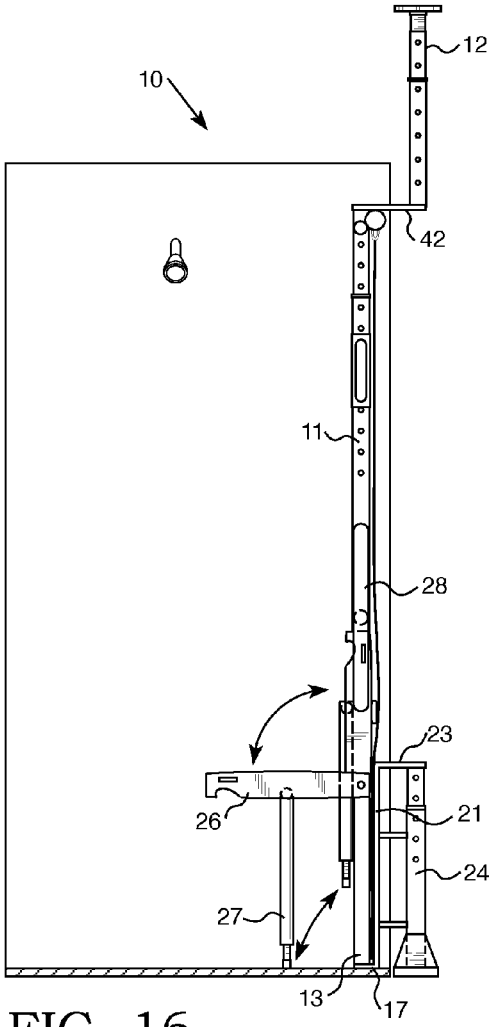
FIGS. 16-18 depict side, top, and front views, respectively, of a second alternative embodiment of a bathroom fixture assembly.
Figure 17:
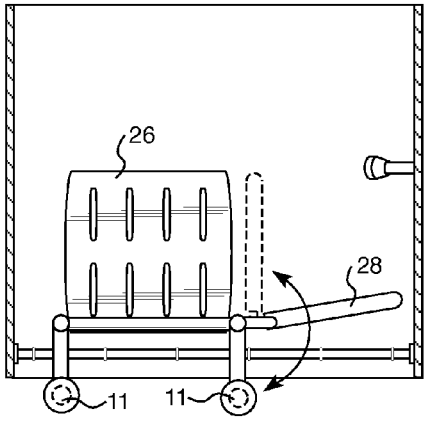
Figure 18:
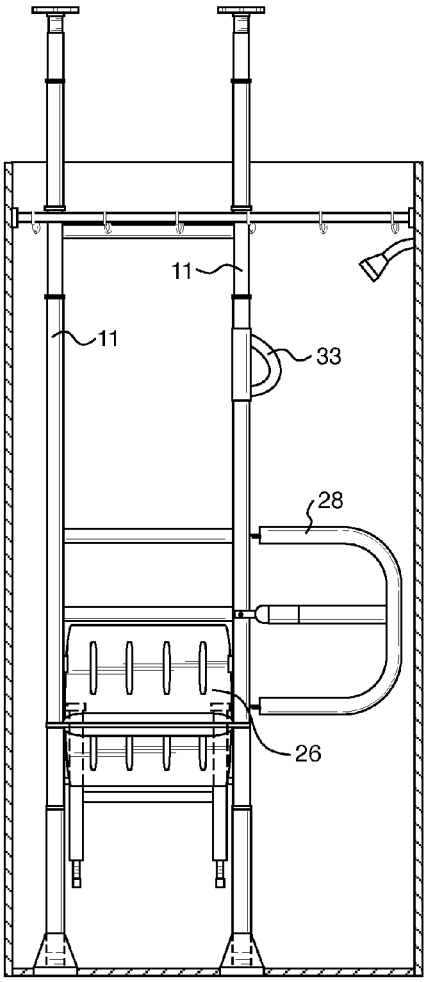

FIGS. 16-18 depict an alternative embodiment of a bathroom fixture assembly 10 configured for use in a shower stall rather than a bathtub or shower having a basin 16. As shown, the second end 13 of the rigid vertical member 11 extends to a location proximal to the shower floor. A rigid horizontal member 17 may be coupled to the second end 13 of the rigid vertical member 11 that extends outward toward the exterior of the shower stall. The rigid horizontal member 17 may be coupled to a vertical curtain channel member 21 that extends upward and is substantially parallel to the rigid vertical members 11 such that a curtain channel 20 is formed that allows a shower curtain to travel and hang therein, thereby a) maintaining a user's privacy while bathing and keeping water from escaping the shower enclosure, while at the same time maintaining a user's immediate and direct access to the bathroom fixture assembly 10 at all times, including when a shower is in progress; and b) maintaining a user's ability to largely hide the bathroom fixture assembly from view by others, simply by use of a normal shower curtain, which—whether the shower is in use or not—generally maintains a clean and tidy bathroom appearance and avoids any real or perceived stigma that may be associated with installing a more visible bathroom fall protection assembly. A horizontal extension member 23 may be coupled to the vertical shower curtain channel member 21 and extend outward to the exterior of the shower stall. A lower rigid vertical member 24 may be coupled to the horizontal extension member 23 and may be configured to couple or otherwise affix to a flooring surface outside of the shower stall. Additionally, as shown, in some embodiments, the rigid vertical member 11 may further comprise an upper horizontal member 42 extending outward to the exterior of the shower stall. This upper horizontal member may be coupled to the first end of the rigid vertical member 11 such that the rigid vertical member 11 may be coupled or otherwise affixed to a ceiling surface outside of the shower stall. Depending upon the shape and dimension of the shower stall, it may be preferable to utilize a single gate 28 rather than a two gates 28 as depicted in other embodiments; however, any appropriate number of gates 28 may be used.

Figure 19:
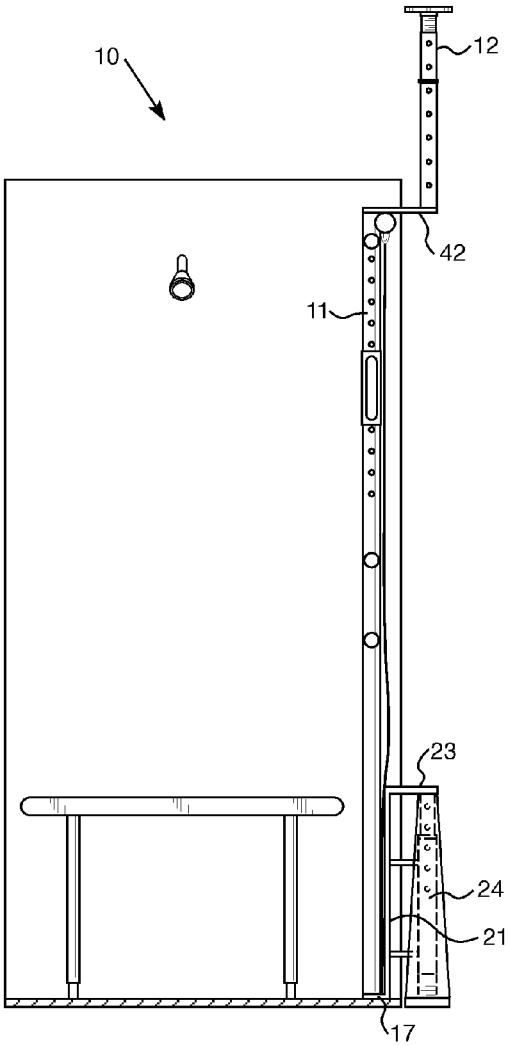
FIG. 19-21 depict side, top, and front views, respectively, of a third alternative embodiment of a bathroom fixture assembly.
Figure 20:
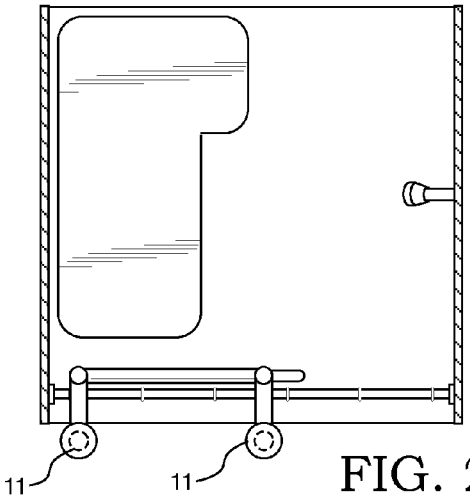
Figure 21:
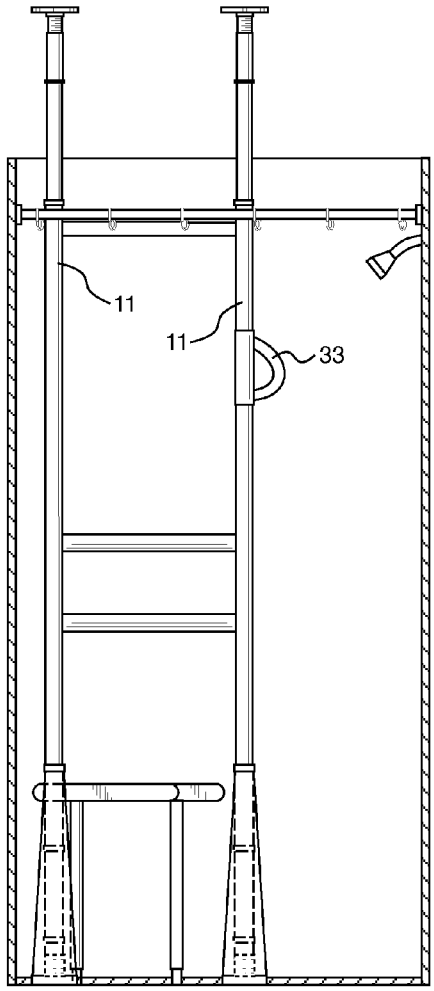
Figure 22:
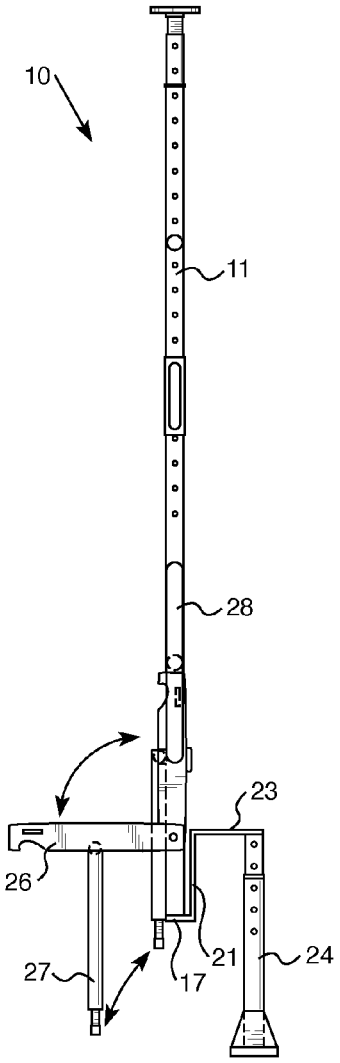
FIGS. 22-24 depict side, top, and front views, respectively, of the embodiment of a bathroom fixture assembly of FIGS. 1-3 outside of a bathtub or shower basin.
Figure 23:
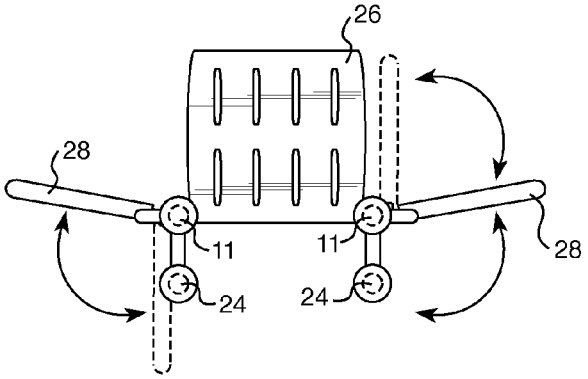
Figure 24:
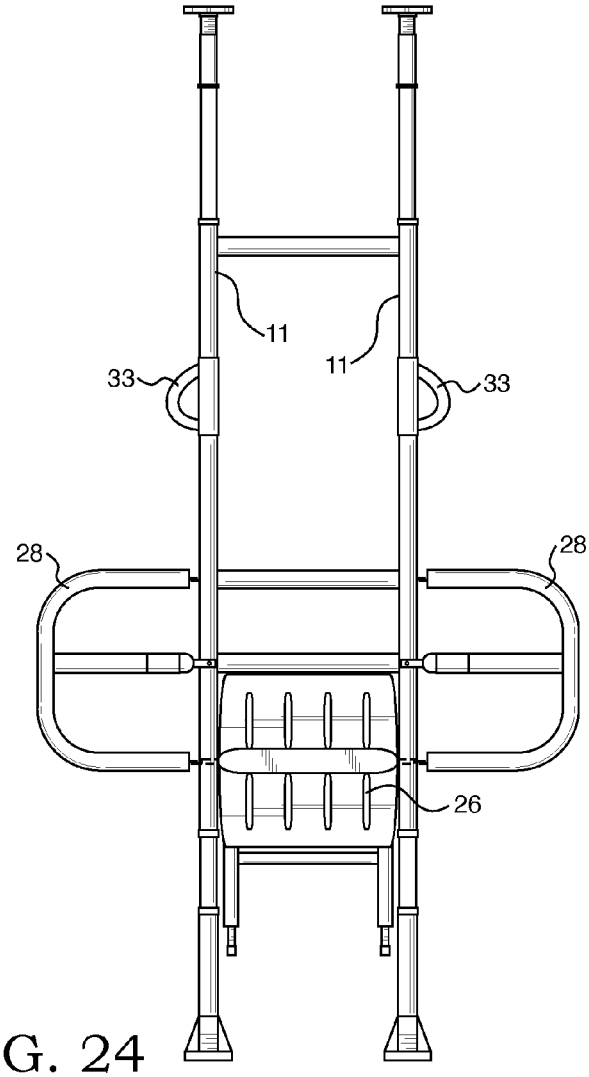

Many showers already have a bench, stool, seat, or other surface on which a user may sit. As such, the embodiment of a bathroom fixture assembly 10 shown in FIGS. 19-21 may be used in conjunction with any existing seat already in the shower stall. Thus, unlike the embodiment of FIGS. 16-18, this embodiment of a bathroom fixture assembly 10 does not have its own seat. This embodiment is also depicted as lacking a gate 28, however, it is also contemplated that a gate 28 may be coupled to one of more of the rigid vertical members 11 if desired.

Figure 25:
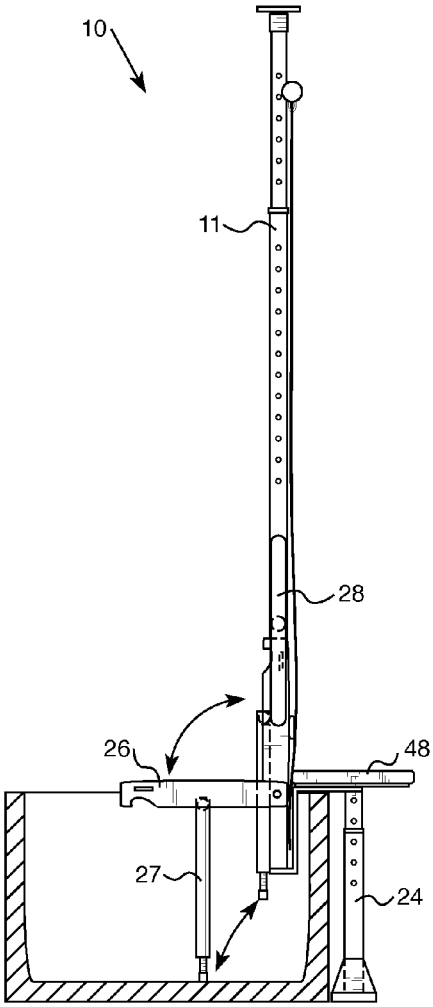
FIGS. 25-27 depict side, top, and front views, respectively, of a fifth alternative embodiment of a bathroom fixture assembly comprising a second seat.
Figure 26:
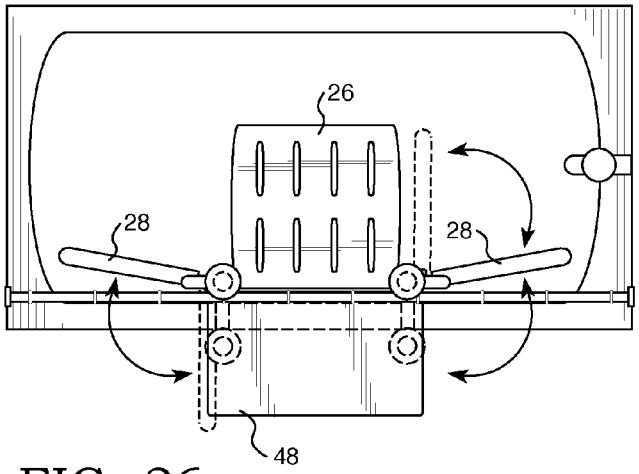
Figure 27:
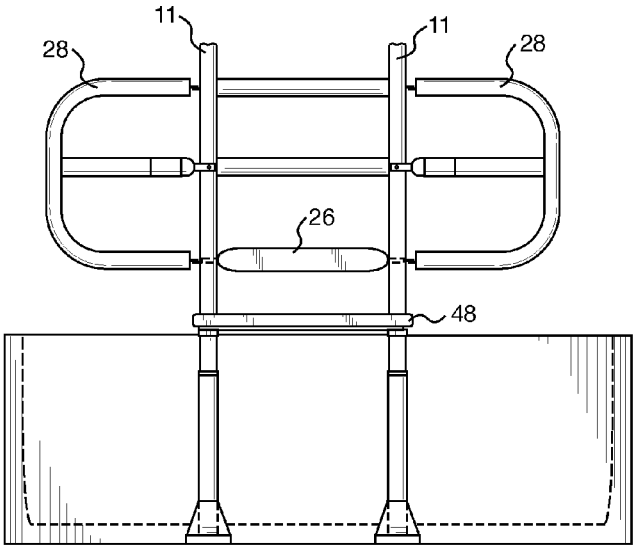

As shown in FIGS. 25-27, some embodiments of a bathroom fixture assembly 10 may further comprise an external accessory seat 48 that is configured to fixedly or removably couple to a horizontal extension member 23 so as to preserve the existence of the shower curtain channel 20. This external accessory seat 48 may be used outside of the bathtub or shower when a user desires an additional seat to use when dressing, disrobing, or while engaged in pre- or post-shower physical therapy or exercise. In implementations comprising two gates 28 as shown, the gates 28 may be swung out of the shower or bathtub and locked on either side of the seat to create one or more "arms" similar to those of an armchair to prevent a user from falling when seated due to slipping or loss of balance, or to stabilize a user while standing or moving near the seat and, e.g., disrobing, drying-off, getting dressed or performing physical therapy exercises.

Figure 29:
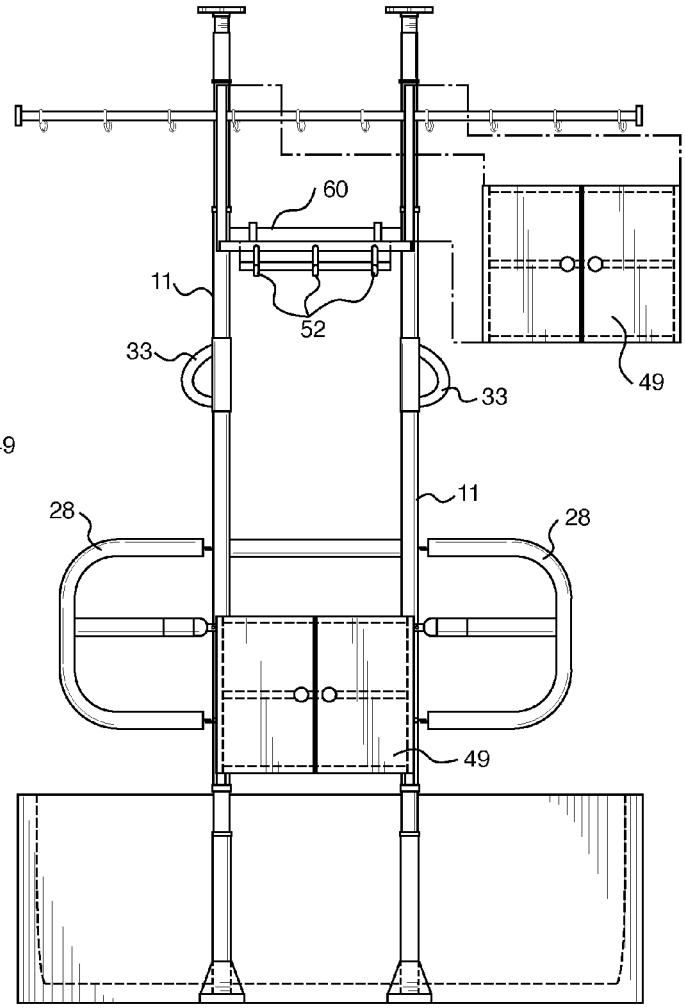
FIG. 28-30 depict side, front, and top views, respectively, of a sixth alternative embodiment of a bathroom fixture assembly comprising a cabinet, robe/towel hooks and a LED light fixture.
Figure 28:
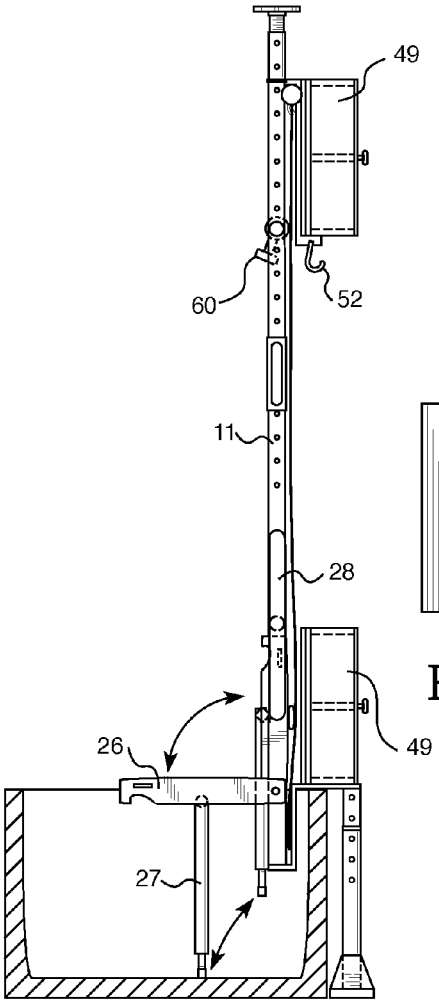
Figure 30:
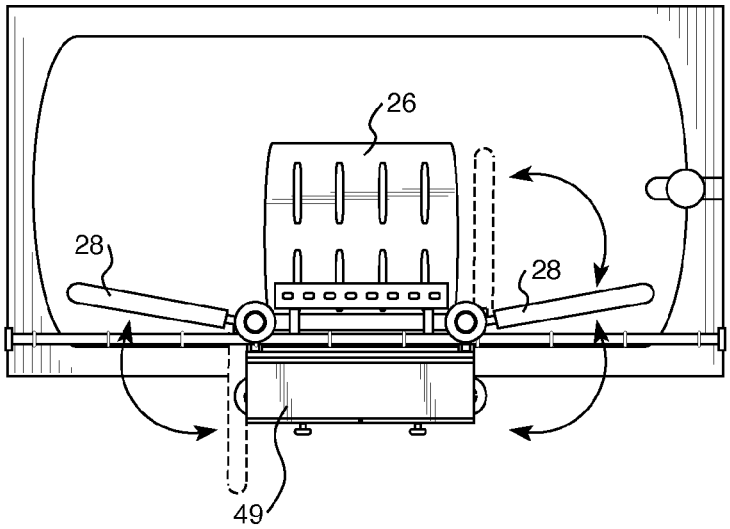
Figure 31:
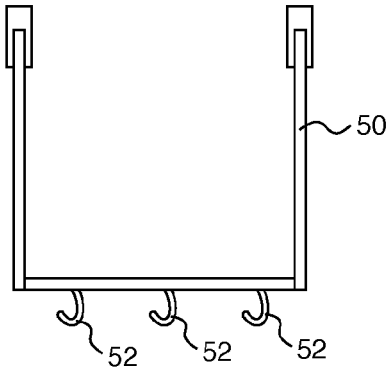
FIGS. 31-32 depict exemplary embodiments of cabinet bracket options.
Figure 32:
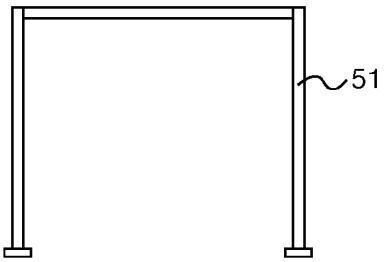

Some embodiments of a bathroom fixture assembly 10 may further optionally comprise one or more cabinets 49 as shown in FIGS. 28-30. These cabinets 49 may couple to the rigid vertical members 11 using the exemplary mounting brackets 50, 51 depicted in FIGS. 31-32, respectively. In some implementations, one or more hooks 52 may be coupled to the cabinet 49 or mounting bracket 50, 51 to hold towels, robes, etc. so that those things may be immediately accessible to one exiting the shower or tub. In other implementations, cabinets 49 may be mounted directly below that area, coupling to and immediately above the upper rigid horizontal extension member 23, which rests atop the external tub basin wall surface 25. Either way, these cabinets do not interfere with the user, the shower curtain or the bathroom fixture assembly's normal function, but may instead enhance the bathing experience by storing needed items in an area of the bathroom that heretofore was vacant and essentially useless.

FIGS. 28-30 further show additional options that the bathroom fixture assembly 10 make possible. These include one or more supplemental LED-type light fixtures 60, which may attach anywhere on the bathroom fixture assembly to provide needed lighting, but is hereby shown as being attached to a stability cross-bar 62, which joins adjacent rigid vertical members 11.

Figure 33:
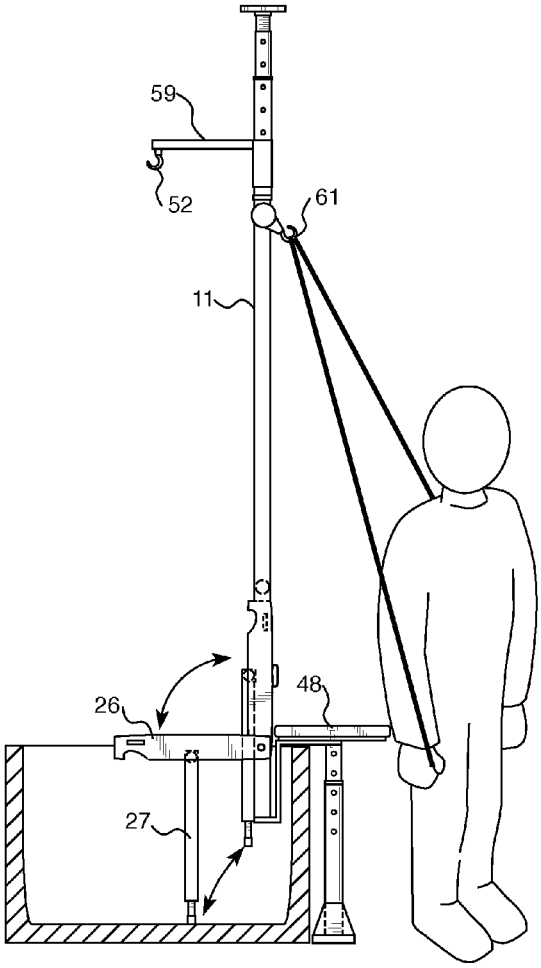
FIGS. 33-34 depict an exemplary embodiment of a bathroom fixture assembly comprising an out-of-shower-facing hook to which a physical therapy exercise band may be coupled, and an inner-shower rotating davit with a hook that may accommodate, a hanging, dripping-wet object.
Figure 34:
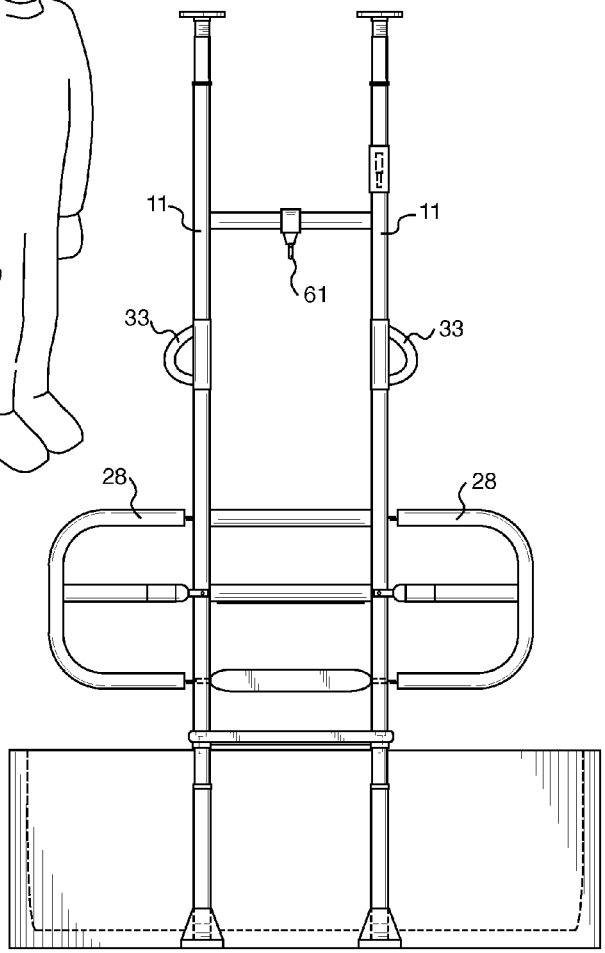

FIGS. 33-34 provide another embodiment comprising a physical therapy and/or exercise sky hook 61 which is designed to hold a physical therapy elastic cord 53 or the like, which is designed so that, either pre- or post-warm shower, the user can leverage the unique height, angle and strength advantages of the bathroom fixture assembly 10, as well as its location that is possibly adjacent to a mirrored and open bathroom area, to safely perform physical therapy or recreational exercises without injury by holding onto or otherwise attaching to oneself the opposite end(s) of the same physical therapy elastic cord 53 or the like and pulling down and/or out on that cord in slow, repetitive and controlled motions, while at the same time being able to rely on any open surface of one or more gate(s) 28 that have been swung and locked open for additional stability and support during such exercise.

Finally, FIGS. 33-34 additionally provide another embodiment comprising an optional davit 59 and hook 52. This davit 59 and hook 52, usually stored out of a user's way, are capable of swinging down from a rigid vertical member 11 and locking over the tub or shower basin area. This creates a convenient hanging vehicle for watering a large hanging house plant, rinsing and/or cleaning a long garment, such as scuba gear, and allowing it to drip dry within the middle of the shower stall, attaching a dog leash to so as to clean a dog within a relatively secure and sheltered shower area, particularly when the gate(s) 28 are in their neutral and locked position, and the like.

It is contemplated that components of the various embodiments described herein may be comprised of any suitable materials that have sufficient rigidity to serve as a grab bar and bathroom fixture assembly 10; however, due to the fact that the bathroom fixture assembly 10 is regularly exposed to water, it may be preferable that the components be comprised of non-corroding materials such as stainless steel, plastic, and/or nylon. In some embodiments, the rigid vertical members 11, gate members 29, 30, and/or grab rings 33 may be comprised at height(s) and of material(s) comprising a diameter of approximately one and one half inches to comply with Americans with Disabilities Act (ADA) specifications.

In places where the description above refers to particular implementations of a bathroom fixture assembly used to reduce the incidence of slip and fall injuries, it should be readily apparent that a number of modifications may be made without departing from the spirit thereof and that these implementations may be applied to other bathroom fixture and grab bar assemblies.

What is claimed is:

1. A bathroom fixture assembly comprising:

a plurality of rigid vertical members each comprising a first end configured to couple to a ceiling and a second end configured to extend downward beyond an upper edge of an outer wall of a basin of a bathtub or shower;

a first horizontal member coupled to the second end of a first rigid vertical member from among the plurality of rigid vertical members and configured to extend outwardly toward the outer wall of the basin of the bathtub or shower;

a first vertical curtain channel member coupled to the first horizontal member and configured to extend upward proximal an interior surface of the outer wall of the basin of the bathtub or shower such that a channel configured to house a shower curtain exists between the first rigid vertical member and the first vertical curtain channel member;

a first horizontal extension member coupled to the vertical curtain channel member and configured to extend horizontally over the upper edge of the outer wall of the basin of the bathtub or shower; and a first lower rigid vertical member from among a plurality of lower rigid vertical members, the first lower rigid vertical member coupled to the first horizontal extension member and configured to extend downward proximal an exterior surface of the outer wall of the basin of the bathtub or shower and couple to a floor surface.

2. The bathroom fixture assembly of claim 1 further comprising:

a seat pivotally coupled between the first rigid vertical member and a second rigid vertical member, the seat configured to pivot from a closed, vertical position to an open position that is substantially perpendicular to the first and second rigid vertical members.

3. The bathroom fixture assembly of claim 2, further comprising at least one leg pivotally coupled to a bottom surface of the seat and configured to retain the seat in the open position when a user is seated on the seat.

4. The bathroom fixture assembly of claim 1, further comprising a first gate coupled to the first rigid vertical member and configured to pivot up to about 180 degrees about the first rigid vertical member.

5. The bathroom fixture assembly of claim 4, further comprising a second gate coupled to a second rigid vertical member from among the plurality of rigid vertical members, the second gate configured to pivot up to about 180 degrees about the second rigid vertical member.

6. The bathroom fixture assembly of claim 4, wherein the first gate comprises a substantially c-shaped member, each end of which is pivotally coupled to the first rigid vertical member and at least one horizontal gate member comprising a first end coupled to the substantially c-shaped member and a second end pivotally coupled to the first rigid vertical member.

7. The bathroom fixture assembly of claim 1, further comprising a grab ring coupled to the first rigid vertical member.

8. The bathroom fixture assembly of claim 1, wherein at least one of the first rigid vertical member and the first lower rigid vertical member comprises at least one of a telescoping section and a threaded adjustable section.

9. A bathroom fixture assembly comprising:

a plurality of rigid vertical members each comprising a first end configured to couple to a ceiling and a second end configured to extend downward beyond an upper edge of an outer wall of a basin of a bathtub or shower;

a first horizontal member coupled to the second end of a first rigid vertical member from among the plurality of rigid vertical members and configured to extend outwardly toward the outer wall of the basin of the bathtub or shower;

a first vertical curtain channel member coupled to the first horizontal member and configured to extend upward proximal an interior surface of the outer wall of the basin of the bathtub or shower such that a channel configured to house a shower curtain exists between the first rigid vertical member and the first vertical curtain channel member;

a first horizontal extension member coupled to the vertical curtain channel member and configured to extend horizontally over the upper edge of the outer wall of the basin of the bathtub or shower;

a first lower rigid vertical member from among a plurality of lower rigid vertical members, the first lower rigid vertical member coupled to the first horizontal extension member and configured to extend downward proximal an exterior surface of the outer wall of the basin of the bathtub or shower; and at least one set screw configured to extend from at least one of the first vertical curtain channel member and the first lower rigid vertical member toward the outer wall of the basin of the bathtub or shower.

10. The bathroom fixture assembly of claim 9, further comprising at least one bumper extending from the first vertical curtain channel member on a surface proximal the interior surface of the outer wall of the basin of the bathtub or shower and at least one bumper extending from the first lower rigid vertical member on a surface proximal the exterior surface of the outer wall of the basin of the bathtub or shower.

11. The bathroom fixture assembly of claim 9, further comprising:

a second horizontal member coupled to the second end of a second rigid vertical member from among the plurality of rigid vertical members and configured to extend outwardly toward the outer wall of the basin of the bathtub or shower;

a second vertical curtain channel member coupled to the second horizontal member and configured to extend upward proximal an interior surface of the outer wall of the basin of the bathtub or shower such that a channel configured to house a shower curtain exists between the second rigid vertical member and the second vertical curtain channel member;

a second horizontal extension member coupled to the second vertical curtain channel member and configured to extend horizontally over the upper edge of the outer wall of the basin of the bathtub or shower;

a second lower rigid vertical member from among the plurality of lower rigid vertical members, the second lower rigid vertical member coupled to the second horizontal extension member and configured to extend downward proximal an exterior surface of the outer wall of the basin of the bathtub or shower; and at least one set screw configured to extend from at least one of the second vertical curtain channel member and the second lower rigid vertical member toward the outer wall of the basin of the bathtub or shower.

12. The bathroom fixture assembly of claim 11, further comprising an exterior support member comprising a first end coupled to the first lower rigid vertical member and a second end coupled to the second lower rigid vertical member.

13. The bathroom fixture assembly of claim 12, wherein the exterior support member further comprises one or more tension screws.

14. The bathroom fixture assembly of claim 12 wherein the first horizontal extension member and the second horizontal extension member are integral to one another.

15. The bathroom fixture assembly of claim 12 wherein the first vertical curtain channel member and the second vertical curtain channel member are integral to one another.

16. The bathroom fixture assembly of claim 14, further comprising a cushion located on an underside of the integral horizontal extension member.

17. The bathroom fixture assembly of claim 11 further comprising:

a seat pivotally coupled between the first rigid vertical member and a second rigid vertical member, the seat configured to pivot from a closed, vertical position to an open position that is substantially perpendicular to the first and second rigid vertical members; and at least one gate coupled to the at least one of the first and second rigid vertical members and configured to pivot up to about 180 degrees about the rigid vertical member to which the gate is pivotally coupled.

18. A bathroom fixture assembly comprising:

a plurality of rigid vertical members each comprising a first end configured to couple to a ceiling and a second end configured to extend downward to a shower floor;

a first horizontal member coupled to the second end of a first rigid vertical member from among the plurality of rigid vertical members and configured to extend outwardly toward the outside of the shower;

a first vertical curtain channel member coupled to the first horizontal member and configured to extend upward proximal the first rigid vertical member such that a channel configured to house a shower curtain exists between the first rigid vertical member and the first vertical curtain channel member;

a first horizontal extension member coupled to the vertical curtain channel member and configured to extend horizontally outward from the shower; and a first lower rigid vertical member from among a plurality of lower rigid vertical members, the first lower rigid vertical member coupled to the first horizontal extension member and configured to extend downward proximal an exterior surface of the outer wall of the basin of the bathtub or shower and couple to a floor surface.

19. The bathroom fixture assembly of claim 18 further comprising:

a second rigid vertical member comprising a first end configured to couple to the ceiling and a second end configured to extend downward to the shower floor; and at least one gate coupled to the at least one of the first and second rigid vertical members and configured to pivot up to about 180 degrees about the rigid vertical member to which the gate is pivotally coupled.

20. The bathroom fixture assembly of claim 18 wherein the first rigid vertical member further comprises an upper horizontal member configured to extend outward from the shower such that the first end of the first rigid vertical member is configured to couple to the ceiling outside of the shower.

* * * * *